US011027877B2

(12) United States Patent
Nakovski

(10) Patent No.: US 11,027,877 B2
(45) Date of Patent: Jun. 8, 2021

(54) LOCKING CARTON

(71) Applicant: Diamond Packaging, Rochester, NY (US)

(72) Inventor: Ilce Nakovski, Rochester, NY (US)

(73) Assignee: Diamond Packaging, Rochester, NY (US)

( * ) Notice: Subject to any disclaimer, the term of this patent is extended or adjusted under 35 U.S.C. 154(b) by 98 days.

(21) Appl. No.: 16/433,580

(22) Filed: Jun. 6, 2019

(65) Prior Publication Data

US 2019/0375537 A1 Dec. 12, 2019

Related U.S. Application Data

(60) Provisional application No. 62/681,117, filed on Jun. 6, 2018.

(51) Int. Cl.

| | |
|---|---|
| ***B65D 5/38*** | (2006.01) |
| ***B65D 5/04*** | (2006.01) |
| ***B65D 5/50*** | (2006.01) |
| ***B65B 5/04*** | (2006.01) |

(52) U.S. Cl.

CPC ..... *B65D 5/38* (2013.01); *B65B 5/04* (2013.01); *B65D 5/5007* (2013.01)

(58) Field of Classification Search

CPC ..... B65D 5/04; B65D 5/38; B65D 5/5007; B65D 5/54; B65D 59/04; B65D 77/04; B65D 77/22

USPC ..... 206/1.5; 229/125.125

See application file for complete search history.

(56) References Cited

U.S. PATENT DOCUMENTS

| | | | | |
|---|---|---|---|---|
| 4,611,754 | A * | 9/1986 | Sutherland | B65D 71/14 206/434 |
| 5,085,322 | A | 2/1992 | Lax | |
| 5,823,341 | A * | 10/1998 | Nakasuji | E05B 73/0023 206/1.5 |
| 5,882,611 | A | 3/1999 | Williams et al. | |
| 9,475,605 | B2 * | 10/2016 | Everett | B65D 5/38 |
| 9,783,335 | B2 * | 10/2017 | Everett | B65D 5/38 |
| 9,981,788 | B2 * | 5/2018 | Skinner | B65D 5/38 |
| 2016/0001937 | A1 | 1/2016 | Skinner | |
| 2016/0251107 | A1 | 9/2016 | Everett | |

FOREIGN PATENT DOCUMENTS

| | | |
|---|---|---|
| WO | 2012121924 | 9/2012 |

OTHER PUBLICATIONS

International Search Report and Written Opinion of the International Application PCT/US2019/35770 dated Aug. 27, 2019, 8 pages.

* cited by examiner

*Primary Examiner* — Bryon P Gehman

(74) *Attorney, Agent, or Firm* — Bond, Schoeneck & King, PLLC; Joseph Noto

(57) ABSTRACT

A locking carton, locking mechanism and method includes an insert including a bridge having at least one pair of locking tabs at the ends thereof and material cutouts in the bottom panel and side walls adjacent to the bridge and an outer sleeve including at least one pair of locking notches corresponding to the at least one pair of locking tabs when in a locked position.

12 Claims, 7 Drawing Sheets

LOCKING CARTON

CROSS REFERENCE

This application claims the benefit of the filing date of U.S. Provisional Patent Application Ser. No. 62/681,117, filed Jun. 6, 2018, which is hereby incorporated by reference in its entirety.

FIELD

The present invention relates generally to a locking carton and in particular to a locking carton having an outer sleeve with a pair of locking notches and an insert having a bridge with a pair of end locking tabs corresponding to the pair of locking notches and related methods.

BACKGROUND

In the field of locking packaging for a wide range of consumer goods, it is desired to provide consumers with secure packaging, particularly healthcare and medication packaging, having features to restrict or prevent access to the contents by a certain group of individuals while at the same time providing access with some degree of ease by another group of individuals.

SUMMARY

In accordance with one aspect of the present disclosure, there is provided a locking carton including an insert having top panel, bottom panel, front wall, back wall and side walls, wherein the bottom panel is composed of a bridge having at least one pair of locking tabs at the ends thereof and material cutouts in the bottom panel and side walls adjacent to the bridge; and an outer sleeve having top, bottom, back wall and side walls, wherein the side walls have at least one pair of locking notches corresponding to the at least one pair of locking tabs when in a locked position.

In accordance with another aspect of the present disclosure, there is provided a locking mechanism, including a bridge having at least one pair of locking tabs at the ends thereof and material cutouts in a bottom panel and side walls adjacent to the bridge, wherein the bridge is moveable between a relaxed position and a flexed position; and a pair of locking notches corresponding to the at least one pair of locking tabs when in a locked position.

In accordance with another aspect of the present disclosure, there is provided a method including moving a bridge of an insert from a relaxed position to a flexed position by sliding an end of the insert into a sleeve; and moving the bridge of the insert from the flexed position to the relaxed position by sliding the insert into the sleeve until a pair of locking tabs at the ends of the bridge protrude through a pair of locking notches of the sleeve, thereby locking the insert within the sleeve.

These and other aspects of the present disclosure will become apparent upon a review of the following detailed description and the claims appended thereto.

DETAILED DESCRIPTION

Figure 1:
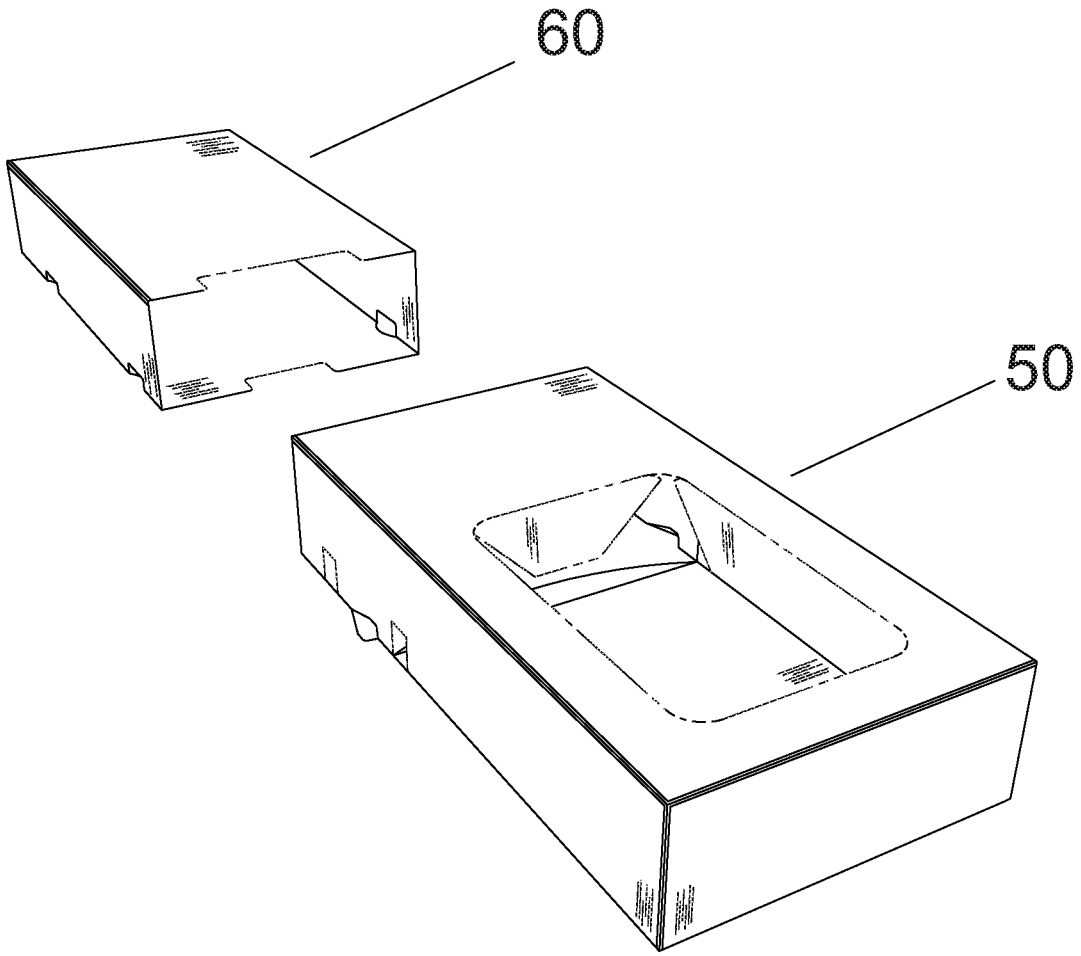
FIG. 1 is a top perspective view of the front of an outer sleeve and insert of a locking carton in an assembled configuration in accordance with the present invention.

The locking carton is a two-piece paper board design that is composed of an insert and an outer sleeve. The outer sleeve contains at least one set of side notches 1, 2, 3, 4 that correspondingly engage with a set of insert tabs 25, 26. The insert contains a bridge 24 having insert tabs 25, 26 at each end and cutouts on the side walls 36, 34 and glue flap 39 and bottom panel 35 adjacent to the bridge 24.

This locking carton uses the combination of the pair of side tabs 25, 26 from a die cut bridge 24 on the insert and corresponding outer sleeve side notches 1,2,3,4 to lock and unlock. The bridge 24 on the bottom of the insert will bend or straighten depending on the location of the tabs 25, 26 in relation to the outer sleeve. This creates the tension and spring required for the tabs 25, 26 to lock and unlock. The size and shape of the cut outs in conjunction with the width of the bridge 24 is what controls how much tension and spring the locking tabs 25, 26 have. This variable makes it possible for the locking mechanism to be used on several different sized cartons. When fully assembled the tabs are in the locked position in the outer sleeve. The package is opened by compressing the locking tabs 25, 26 simultaneously and causing the bridge 24 to bow upward inside the insert slightly releasing the tabs 25, 26 from the notches 1, 2, 3, 4 in the outer sleeve. In an embodiment, a second set of notches 1, 2 are optional in the outer sleeve to cooperate with the tabs 25, 26 or to cooperate with internal stops, to prevent the insert from being pulled out all the way. The tension on the tabs 25, 26 from the bridge 24 design causes the carton to automatically lock after sliding the insert into the closed position.

Figure 2:
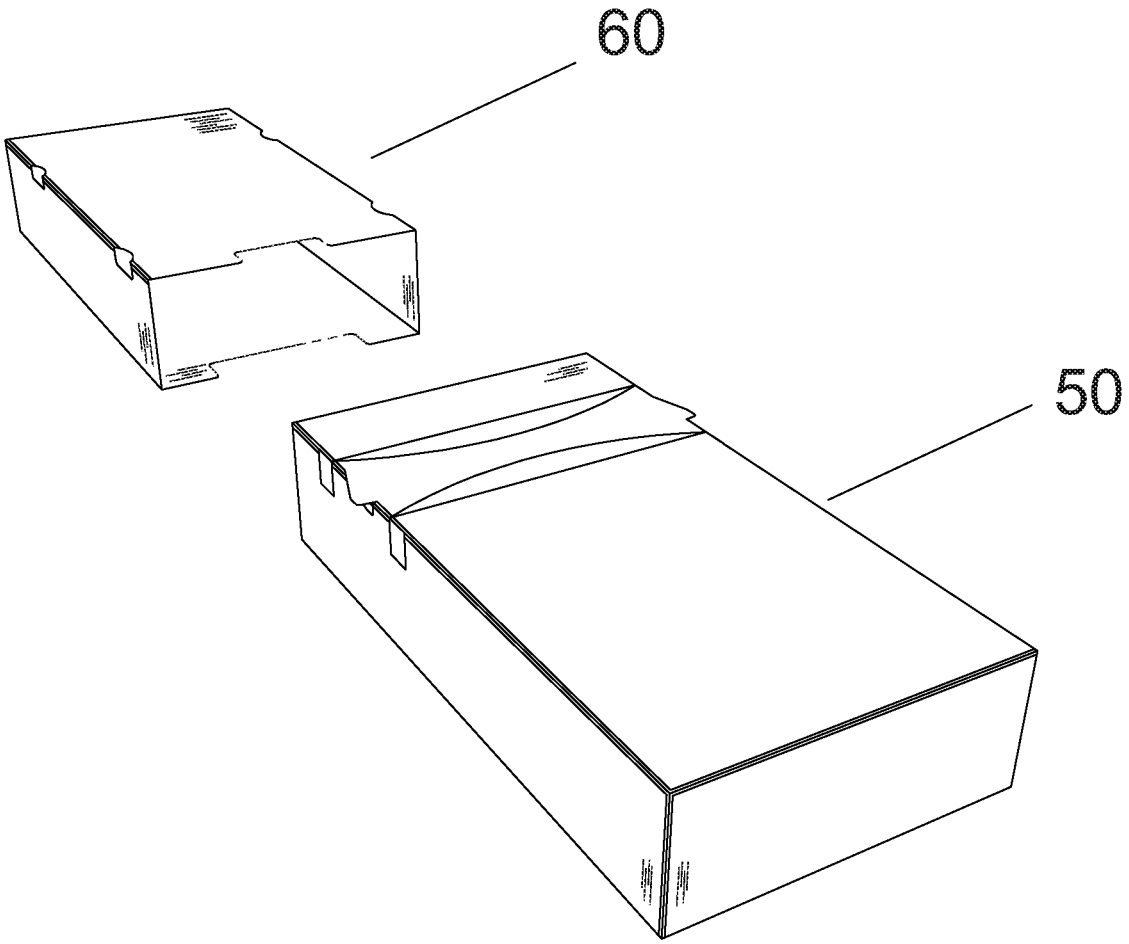
FIG. 2 is a bottom perspective view of the front of an outer sleeve and insert of the locking packaging container in an assembled configuration.

FIG. 1 shows a top perspective view of the front of an outer sleeve 50 and an insert 60 of a locking carton in an assembled configuration and FIG. 2 shows a bottom perspective view of the front of the outer sleeve 50 and insert 60 of the locking packaging container in an assembled configuration in accordance with an embodiment of the present invention.

Figure 3:
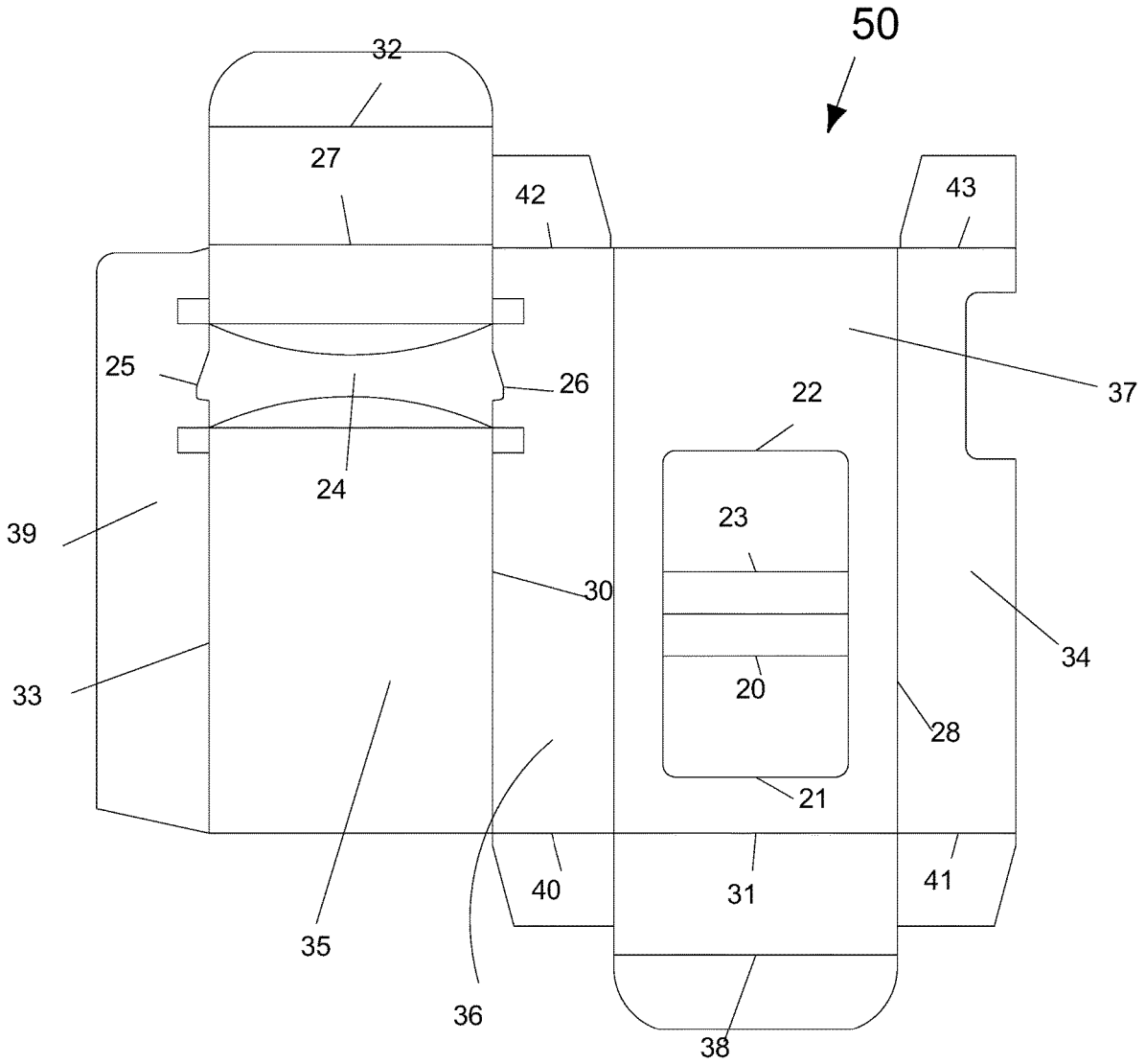
FIG. 3 is a print side up view of the insert unglued and unassembled.
Figure 4:
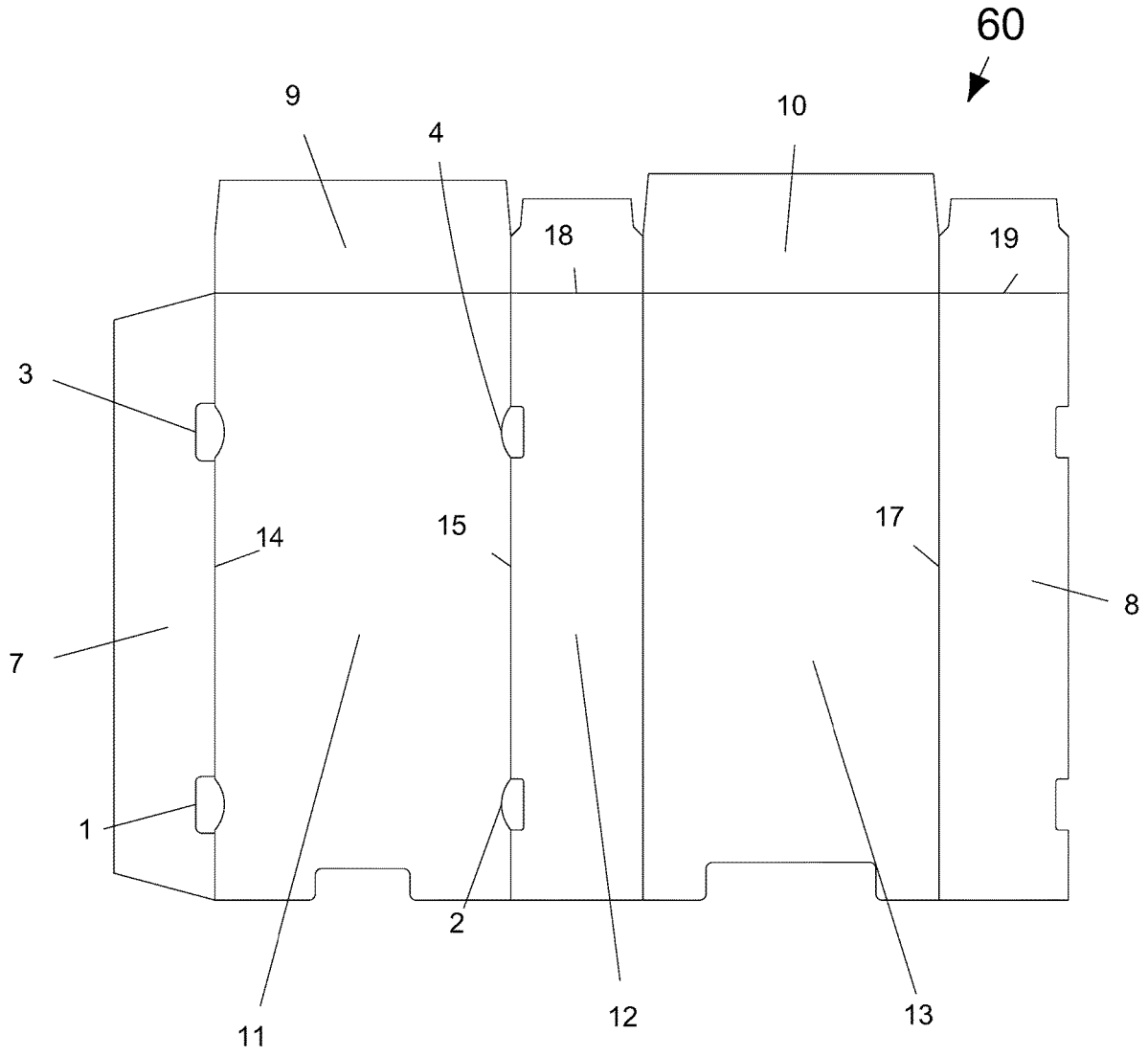
FIG. 4 is a print side up view of the outer sleeve unglued and unassembled.

FIG. 3 is a print side up view of the insert 50 unglued and unassembled and FIG. 4 is a print side up view of the outer sleeve 60 unglued and unassembled.

Figure 5:
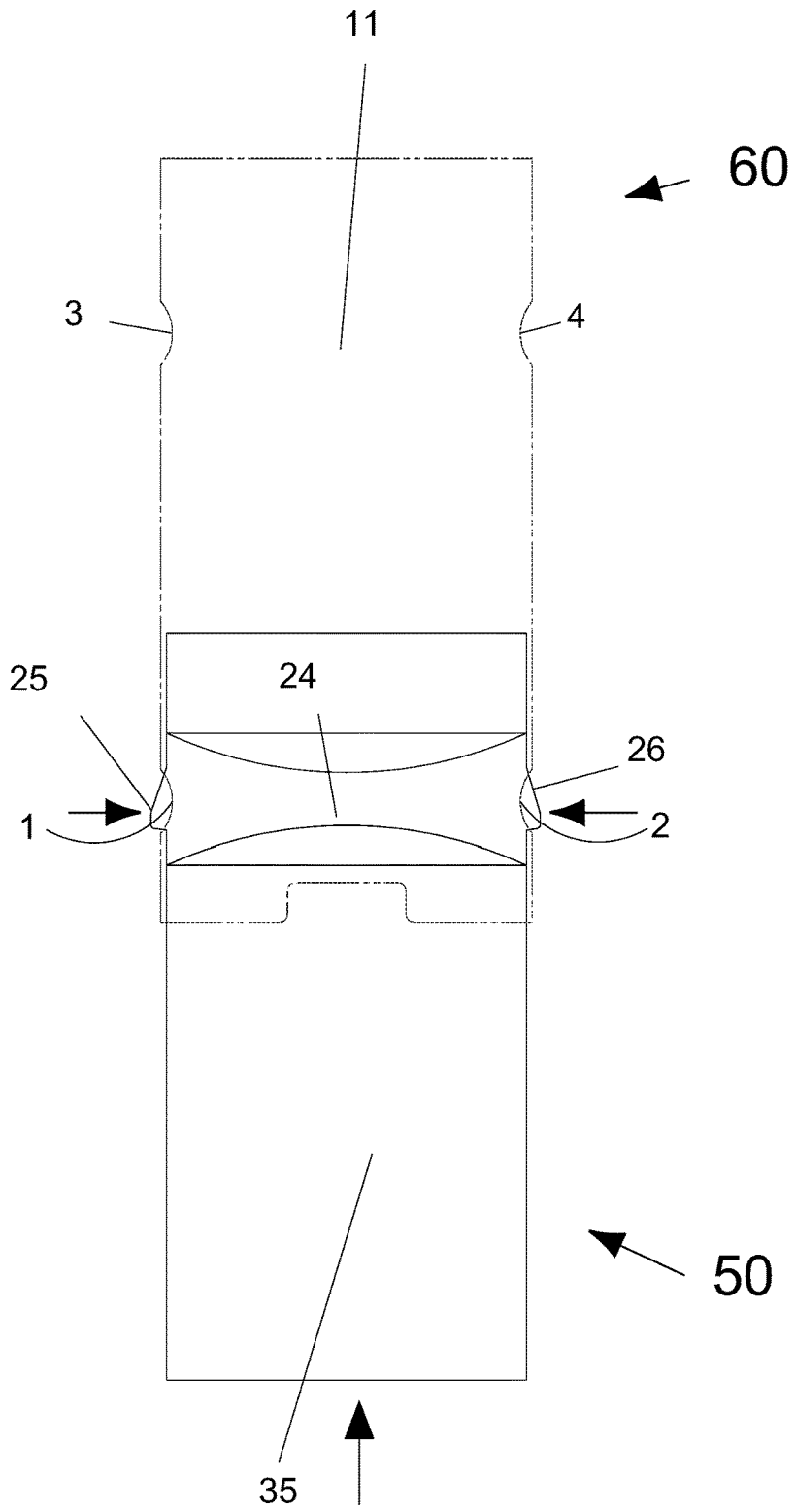
FIG. 5 is a bottom view of the insert first going into the sleeve and tabs locking into a first set of notches.

FIG. 5 is a bottom view of the insert 50 first going into the sleeve 60 and the tabs 25, 26 locking into a first set of the notches 1, 2.

Figure 6:
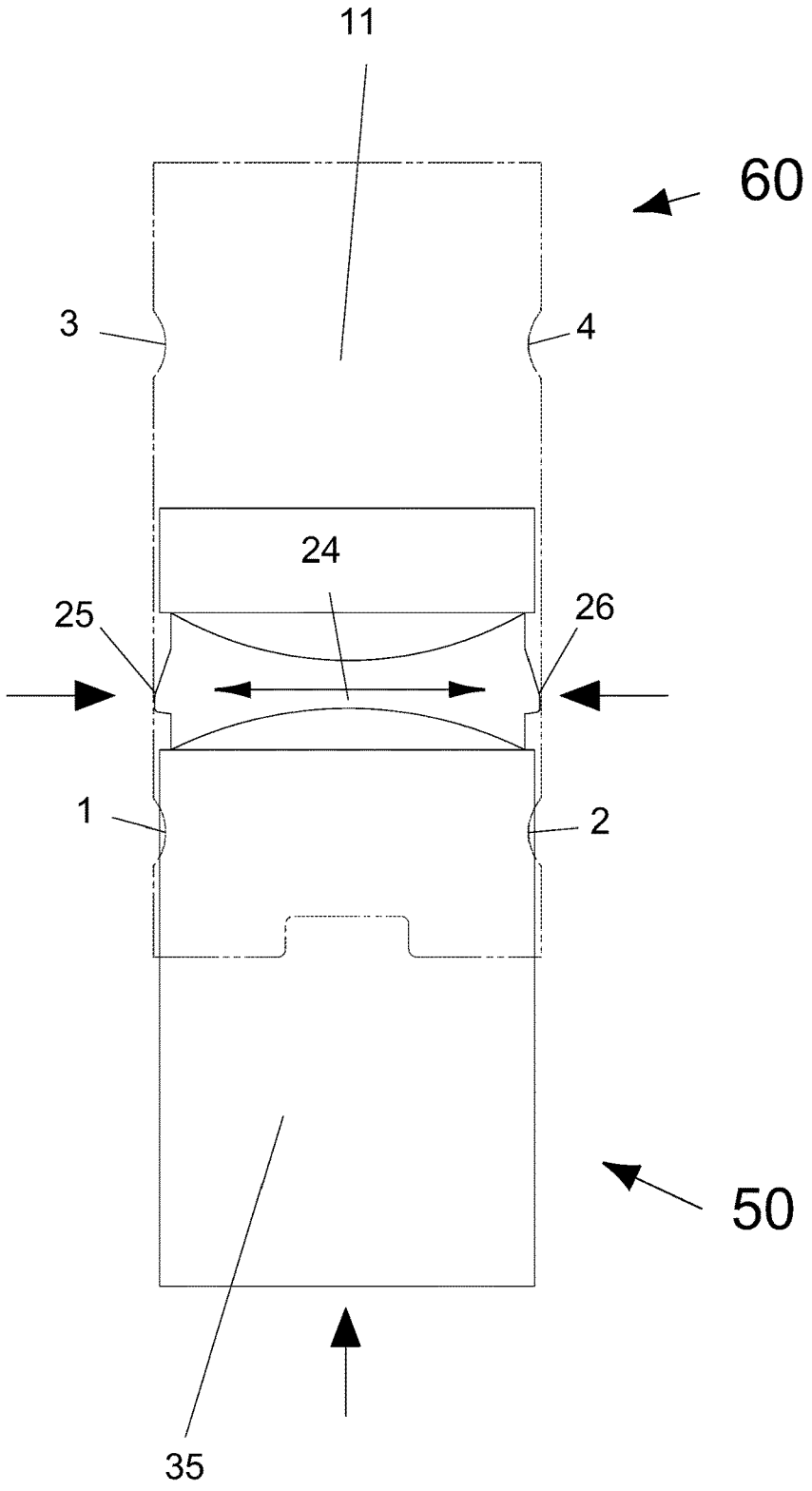
FIG. 6 is a bottom view of the bridge being compressed into a bowing arc to allow the tabs to pass by the walls of the sleeve while being pushed fully into the sleeve.
Figure 7:
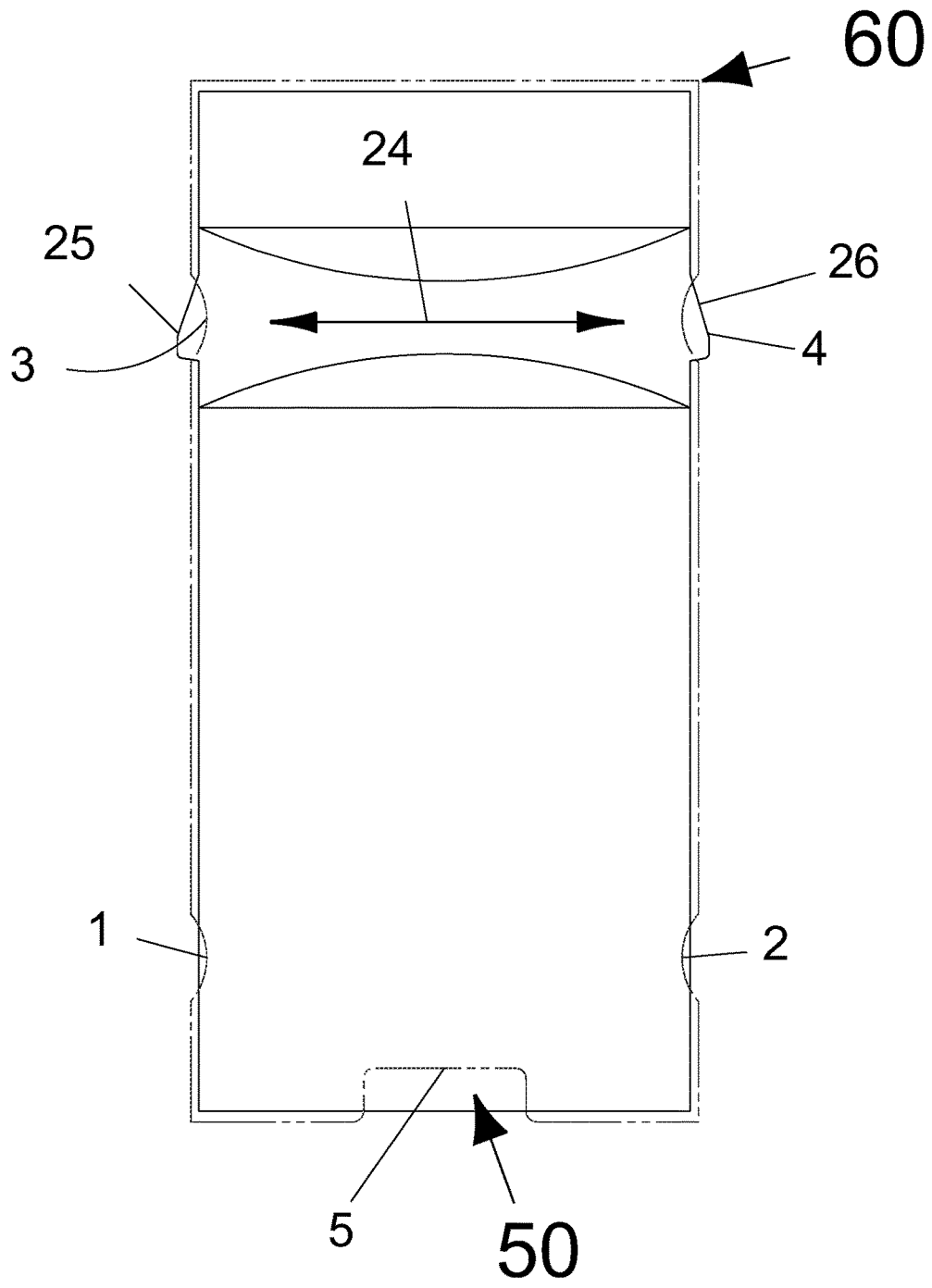
FIG. 7 is the bottom view of the insert and sleeve when fully inserted and locked into a second set of notches.

FIG. 6 is a bottom view of the bridge 24 being compressed into a bowing arc to allow the notches 25, 26 to pass by the walls 8, 12 of the sleeve 60 while being pushed fully into the sleeve 60. FIG. 7 is the bottom view of the insert 50 and sleeve 60 when fully inserted and locked into a second set of notches 3, 4.

The disclosure will be further illustrated with reference to the following specific examples. It is understood that these examples are given by way of illustration and are not meant to limit the disclosure or the claims to follow.

Brief Statements for Assembling.

Referencing FIG. 4 the process of gluing the sleeve begins with flipping the sleeve to its unprinted side and folding the crease 15 at 180 degrees.

Place an even strip of glue vertically onto the glue flap 7.

Next panel 8 of the top 13 will be folded 180 degrees at the score 17 to overlap the glue flap 7 of the bottom 11 and adhere together. Score 14 should preferably be 1/32 away from panel 8.

Proceed with erecting the sleeve 60 into a rectangular shape, and fold the dust flaps 18, 19 at 90 degrees towards the inside of the sleeve.

Fold the left seal end 9 down over the top of the dust flaps 18, 19.

Apply an even strip of glue horizontally to the top of the left seal end 9.

Fold the right seal end 10 over the top of the left seal end 9 to adhere them together.

Referencing FIG. 3 the gluing process begins with flipping the insert 50 to the uncoated or unprinted side, fold the insert 180 degrees at the working score 30.

Place an even strip of glue vertically on the glue flap 7.

Fold the panel 34 at 180 degrees at the score 28 to overlap the glue flap 39 and adhere them together. Score 33 should preferably be 1/32 away from panel 34.

Erect the insert 50 into a rectangular shape.

Close the tuck flap side of the insert 50 by folding the dust flaps 42, 43 at a 45-degree angle and bending scores 27 and 32 at a 90-degree angle slipping the friction tuck between the cartons front panel and dust flaps.

Repeat for the bottom tuck 38, 31 and dust flaps 40,41.

Apply little pressure to top panel 37 at tray area at the back-fold crease 20.

The panel will start folding into itself at score 21, simultaneously back fold crease 20.

Continue to bend and crease 20 until it reaches a 90-degree angle with the bottom of carton and score 21 to lay flat onto the bottom panel 35.

Repeat previous step for the other flap of trap at the crease 23 and the score 22.

Place pointer finger in the center of the bridge 24 located on bottom of the insert 50, use your thumb and middle finger to slightly compress the locking tabs while pressing the bridge down.

Place product inside the insert 50.

Apply light pressure onto locking tabs and insert into the outer sleeve; continue past first set of locking notches 3, 4 (optional) until the insert 50 cannot go any further and the set of locking tabs locks in the end set of locking notches.

Brief Steps for Unlocking/Opening.

With one hand apply pressure to both locking tabs 25, 26 simultaneously, while pulling the insert 50 containing the product out of the sleeve 60 using the outer sleeve finger voids 5 with the other hand.

Although various embodiments have been depicted and described in detail herein, it will be apparent to those skilled in the relevant art that various modifications, additions, substitutions, and the like can be made without departing from the spirit of the disclosure and these are therefore considered to be within the scope of the disclosure as defined in the claims which follow.

What is claimed:

1. A locking carton comprising:

an insert comprising a top panel and a bottom panel connected by a front wall, back wall and two side walls, wherein the bottom panel is comprised of a flexible bridge having two ends and a respective tab at each; and an outer sleeve comprising a top panel and a bottom panel, connected by a back wall and two side walls, wherein the side walls comprise at least one pair of notches corresponding to the bridge tabs when in a locked position.

2. The carton of claim 1, wherein the tabs and notches are configured to lock the insert in its entirety inside the outer sleeve.

3. The carton of claim 1, wherein the sleeve insert further comprises a second pair of notches which cooperate with the bridge tabs to restrict the complete removal of the insert from the sleeve.

4. The carton of claim 1, wherein the insert is configured to receive an article within the insert.

5. The carton of claim 1, wherein the insert and sleeve comprise paperboard or plastic.

6. The carton of claim 1, further comprising material cutouts in the bottom panel of the insert on each side of the bridge and in the side walls adjacent to the bridge.

7. A locking mechanism, comprising:

a flexible bridge having two ends and a respective tab at each end in a bottom panel of an insert wherein the bridge is moveable between a relaxed position and a flexed position; and at least one pair of notches in a sleeve corresponding to the tabs when in a locked position.

8. The locking mechanism of claim 7, further comprising material cutouts in the bottom panel of the insert on each side of the bridge and in side walls adjacent to the bridge.

9. A method comprising:

sliding an end of an insert comprising a bridge having two ends and a respective tab at each end into a sleeve causing the bridge to flex from a relaxed position to a flexed position until the tabs at the ends of the bridge protrude through corresponding notches of the sleeve causing the bridge to move from the flexed position to the relaxed position, thereby locking the insert within the sleeve.

10. The method of claim 9, further comprising:

unlocking the insert from the sleeve by depressing the pair of tabs protruding from the pair of notches of the sleeve thereby moving the bridge from the relaxed position to the flexed position and partially sliding the insert out of the sleeve.

11. The method of claim 9, further comprising inserting an article into the insert prior to sliding the insert into the sleeve.

12. The method of claim 11, further comprising:

unlocking the insert from the sleeve by depressing the pair of tabs protruding from the pair of notches of the sleeve thereby moving the bridge from the relaxed position to the flexed position and partially sliding the insert out of the sleeve to expose the article.

* * * * *